US008991587B2

(12) United States Patent
Hoffmann

(10) Patent No.: US 8,991,587 B2
(45) Date of Patent: Mar. 31, 2015

(54) METHOD OF SETTING RECIPROCAL POSITION OF FILTER SEGMENTS ON A CARRIER ELEMENT OF A GROUPING UNIT IN A PROCESS OF MANUFACTURING MULTI-SEGMENT FILTERS

(75) Inventor: Hans-Reiner Hoffmann, Grevenbroich (DE)

(73) Assignee: International Tobacco Machinery Poland SP. Z O.O, Radom (PL)

( * ) Notice: Subject to any disclaimer, the term of this patent is extended or adjusted under 35 U.S.C. 154(b) by 53 days.

(21) Appl. No.: 13/642,941

(22) PCT Filed: May 4, 2011

(86) PCT No.: PCT/PL2011/000046

§ 371 (c)(1),
(2), (4) Date: Oct. 23, 2012

(87) PCT Pub. No.: WO2011/139169

PCT Pub. Date: Nov. 10, 2011

(65) Prior Publication Data

US 2013/0037379 A1 Feb. 14, 2013

(30) Foreign Application Priority Data

May 6, 2010 (PL) ..... 391160

(51) Int. Cl.
*A24D 3/02* (2006.01)

(52) U.S. Cl.
CPC ..... *A24D 3/0287* (2013.01); *A24D 3/0295* (2013.01)
USPC ..... 198/460.1; 493/39

(58) Field of Classification Search
CPC ..... A24C 5/52; A24D 3/02; A24D 3/027; A24D 3/0287; A24D 3/0295
USPC ..... 493/39
See application file for complete search history.

(56) References Cited

U.S. PATENT DOCUMENTS 3,267,820 A 8/1966 Molins et al.
4,212,541 A * 7/1980 Ducommun et al. ..... 356/430

(Continued)

FOREIGN PATENT DOCUMENTS

EP 1 767 107 A 3/2007
GB 1 053 547 A 1/1967

(Continued)

OTHER PUBLICATIONS

International Search Report of PCT/PL2011/000046, mailing date Sep. 29, 2011.

(Continued)

*Primary Examiner* — Gene Crawford
*Assistant Examiner* — Thomas Randazzo
(74) *Attorney, Agent, or Firm* — Westerman, Hattori, Daniels & Adrian, LLP

(57) ABSTRACT

Setting of reciprocal position of filter segments (3) delivered from multiple modules (1) of a machine for manufacturing filters is accomplished by registering the position and the length of a segment (3) from each module (1) on a carrier element (2) of a grouping unit when the filter manufacturing process is switched off, after which the reciprocal position of the segments (3) and the length between the segments (3) are set. The said operations may be accomplished by means of a sensor (4), the registering element (12) or by mapping the relative positions of adjacent segments (3) in the control system.

13 Claims, 7 Drawing Sheets

(56) References Cited

U.S. PATENT DOCUMENTS

Figure 1A:
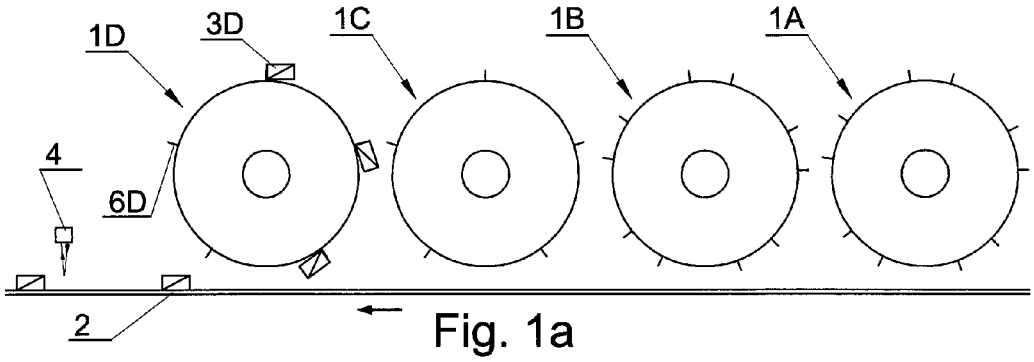

| | | | | |
|---|---|---|---|---|
| 4,238,994 | A | 12/1980 | Koch | |
| 4,723,559 | A * | 2/1988 | Labbe | 131/94 |
| 5,127,511 | A * | 7/1992 | Keen et al. | 198/460.1 |
| 5,392,359 | A * | 2/1995 | Futamura et al. | 382/141 |
| 5,432,600 | A * | 7/1995 | Grollimund et al. | 356/237.2 |
| 7,168,430 | B2 * | 1/2007 | Grothaus | 131/280 |
| 7,784,356 | B2 * | 8/2010 | Spiers et al. | 73/856 |
| 8,118,721 | B2 * | 2/2012 | Cieslikowski et al. | 493/39 |
| 8,172,739 | B2 * | 5/2012 | Horn et al. | 493/39 |
| 8,360,947 | B2 * | 1/2013 | Eusepi et al. | 493/39 |
| 8,464,724 | B2 * | 6/2013 | Balletti et al. | 131/88 |
| 8,515,570 | B2 * | 8/2013 | Lee | 700/110 |
| 8,584,829 | B2 * | 11/2013 | Cieslikowski | 198/460.1 |
| 2002/0119873 | A1 * | 8/2002 | Heitmann | 493/39 |
| 2004/0102299 | A1 * | 5/2004 | Meyer et al. | 493/39 |
| 2004/0250824 | A1 * | 12/2004 | Gosebruch | 131/341 |
| 2005/0054501 | A1 * | 3/2005 | Schroder | 493/39 |
| 2005/0098744 | A1 * | 5/2005 | Schroder et al. | 250/559.19 |
| 2007/0091326 | A1 * | 4/2007 | Schroeder et al. | 356/625 |
| 2007/0117700 | A1 | 5/2007 | Kushihashi et al. | |
| 2009/0145449 | A1 | 6/2009 | Cieslikowski et al. | |

FOREIGN PATENT DOCUMENTS

| | | |
|---|---|---|
| GB | 1 146 259 A | 3/1969 |
| GB | 2 151 901 A | 7/1985 |

OTHER PUBLICATIONS

Written Opinion of PCT/PL2011/000046, mailing date Sep. 29, 2011.

* cited by examiner

METHOD OF SETTING RECIPROCAL POSITION OF FILTER SEGMENTS ON A CARRIER ELEMENT OF A GROUPING UNIT IN A PROCESS OF MANUFACTURING MULTI-SEGMENT FILTERS

The object of the invention is a method of setting reciprocal position of individual segments occurring in the multi-segment filter which are fed onto a carrier element of a grouping unit from the modules of the machine used in the tobacco industry in the process of manufacturing multi-segment filters for cigarettes.

In the tobacco industry, there is a demand for multi-segment filters used in the production of cigarettes which consist of at least two types of segments made of different filtration materials; such segments may be soft, filled for example with unwoven cloth, paper, cellulose acetate, or hard, filled with granulate, sintered elements or hollow cylinders. The created series of segments is then divided appropriately into filters used for manufacturing cigarettes. One known method of making multi-segment filters is an end-wise method whose operating principle was presented several times in patent descriptions owned by the British company MOLINS Ltd. For example, British patent description No. GB 1.146.259 shows a method of manufacturing filters consisting of at least three different segments and a machine enabling the use of such method, consisting of three modules. Segments are formed by cutting, with circular cutters, filter rods moving peripherally on three different drums, and the cut sets of segments are removed from each flute of the drum with a chain conveyor provided with pushers, working always in a vertical plane inclined by a slight angle from the axis of the cutting drum. Segments are then removed by ejectors from the chain conveyor onto a rotating intermediate disc mounted horizontally, whose pushers, situated on the perimeter, transfer segments endwise along the horizontal track of the grouping tape to a worm drum regulating the movement of the segments, while earlier, segments of another type obtained by cutting filter rods on drums in the other modules, are fed in a similar manner into the empty spaces between the segments onto the grouping tape. In the presented structure the intermediate disc of the central module has pushers making additionally reciprocating motion when encountering resistance of defined strength, caused by wedging of filter segments. Said transfer is possible by using a ball clutch, which protects the pushers against damage in case of malfunction of the device. Another British patent description filed by the same company, No. GB 2.151.901, presents a device in which rods filled with tobacco are fed onto the horizontal track of the grouping tape by a set of discs mounted horizontally, while the filter segments cut on the drum are inserted respectively into the empty spaces between the rods by means of rotating discs situated vertically above the tape track. The problem of mechanical setting of reciprocal position of filter segments on the grouping tape for two or three types of segments was solved in the description of the British patent of the said company No. GB 1.053.547, where a wheel provided with two peripheral flutes situated above a roller guiding the perforated tape delivering the segments was used. Each flute of the wheel is provided with suitable sets of suction opening groups, where five openings in each group were shown, and the groups are evenly spaced on the circumference of the wheel. The suction opening groups which are connected with one flute are offset circumferentially from suction opening groups which are connected with the second flute. The said openings have a connection to the atmosphere through suitable adjacent wheel surfaces, whereas each adjacent surface near the lowest part of the circumference of the wheel is provided with a suction chamber which is connected with the source of vacuum through a tube, and the suction openings come into contact with the said chamber. The wheel is rotated with the rotational speed higher than the linear velocity of filter rollers so that the movement of one type of segments with the rotational speed of the wheel is forced by sucking them into the appropriate flute in the time when the group of openings connected with it joins to the chamber. So successive segments are axially separated from each other to a distance greater than the length of segments of the second type, and this spacing is maintained on the perforated tape whose speed is equal to the peripheral speed of the wheel. Successive segments of the second type are likewise axially separated from each other by holding by means of vacuum in the appropriate flute of the wheel, and, as the groups of both kinds of openings are offset on the circumference of the wheel, the separated segments of one type are linearly shifted in relation to separated segments of the second type. In the known state of the art, no easy in practice and reliable method of setting the reciprocal position of any required number of filter segments on the grouping tape in the course of preparation of the production line for the start-up was presented.

According to the invention, the method of setting reciprocal position of filter segments on the carrier element of the grouping unit in the process of manufacturing multi-segment filters used in the tobacco industry for cigarettes, wherein the segments from multiple modules of the machine for manufacturing filters are delivered Onto the carrier element of the grouping unit and arranged in a sequence corresponding to the structure of the cigarette filter, and the designation of the sequence of said modules was adopted in the direction corresponding to the direction of movement of segments on the carrier element, consist in registering, with the process of manufacturing filters stopped, the position and length of the segment from each module on the carrier element of the grouping unit, and then setting the reciprocal position of segments and the distance between segments. For this purpose, segments from successive modules are fed separately onto the moving carrier element of the grouping unit and moved to the area of operation of a sensor registering the position and the length of segments, after which, by means of the sensor, the length of fed segment and its position relative to the carrier element of the grouping unit is registered and the registered results are stored in the control system of the machine for manufacturing filters and, after storing the registered information with regard to segments delivered from all modules, the required sequence of segments and the distance between segments are set virtually in the said control system, with the position of mechanisms of individual modules being adjusted by means of the control system so as to enable obtaining the virtually set sequence of segments on the carrier element of the grouping unit. The length and position of the segments may be registered by means of one sensor, common for all modules and situated behind the last module or by means of separate sensors, each of which is situated behind the respective module, wherein the sensor may constitute an optical element operating in the range of visible radiation or invisible radiation, or constitute an ultrasonic element. In another embodiment of the method according to the invention, the segments from the last module are fed onto the carrier element of the grouping unit, after which said carrier element is stopped in such reference position that the fed segments are behind the last module and the position of the segment is marked on the registering element situated next to the carrier element, and then the segments are removed from the carrier element. Then the segments from the next to last module are fed onto the carrier element of the grouping unit, after which the carrier element is stopped in such reference position that the fed segments are next to the said registering element, the position of the fed segment is marked on that registering element and the segments are removed from the carrier element, and then the marked position of the segment fed from the next to last module is compared to the previously marked position of the segment from the last module and the position of mechanisms of the next to last module is adjusted so as to obtain the expected position of the segment from the next to last module in relation the segment from the last module, after which the next to last module is restarted for the purpose of comparison and control of the position of fed segments in the reference position of the carrier element with the position registered previously at the registering element. The procedure as for the segments from the next to last module is carried out for segments from successive modules, until the first module. In yet another embodiment of the method according to the invention, the segments from the last module are fed onto the carrier element of the grouping unit, after which the position of the segment is marked on the registering element situated next to the carrier element using a stroboscopic device, and then the segments are removed from the carrier element. Then the segments from the next to last module are fed onto the carrier element of the grouping unit, after which the position of the fed segment is marked on the registering element using the stroboscopic device and the segments are removed from the carrier element, and then the marked position of the segment fed from the next to last module is compared with the previously marked position of the segment from the last module and the position of mechanisms of the next to last module is adjusted so as to obtain the expected position of the segment from the next to last module in relation to the segment from the last module, after which the next to last module is restarted for the purpose of comparison and control of the position of fed segments from the next to last module with the position of segments from the last module registered on the registering elements. The procedure as for the segments from the next to last module is carried out for segments from successive modules, until the first module. In another embodiment of the method according to the invention, the segments from the first module are fed onto the carrier element of the grouping unit and the segments are moved so that the first fed segment is in the feeding area of segments from the second module onto the carrier element, after which the position of the device feeding the segments form the second module is set taking into consideration the position of the segment from the first module on the carrier element of the grouping unit and the set position of the feeding device of the second module is stored, and the control system adjusts the arrangement of the remaining mechanisms of the module. Afterwards, the segments from the first and second modules arranged in a defined sequence on the carrier element are moved so that the said segments are in the feeding area of segments from the third module, after which the position of the device feeding segments from the third module is set taking into consideration the position of segments from the second and first modules on the carrier element of the grouping unit and the set position of the feeding device of the third module is stored, and the control system adjusts the arrangement of the remaining mechanisms of the module. The procedure as for the segment of the third module is carried out for segments from successive modules, until the last module. The application of the method according to the invention allows considerable time saving, especially during the change of the structure of manufactured filter, and reduces the loss of material when setting the position of filter segments on the carrier element of the grouping unit.

Figure 1B:
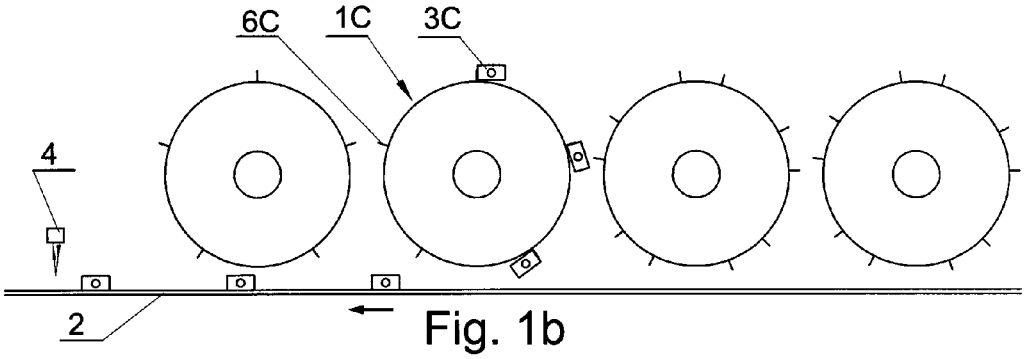
Figure 1C:
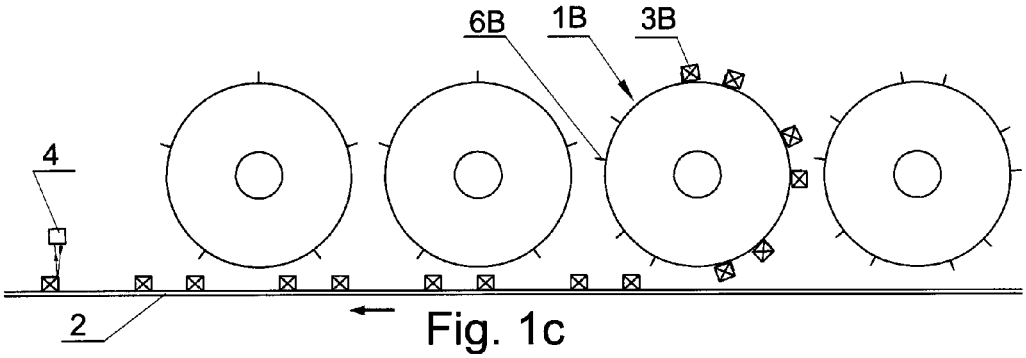
Figure 1D:
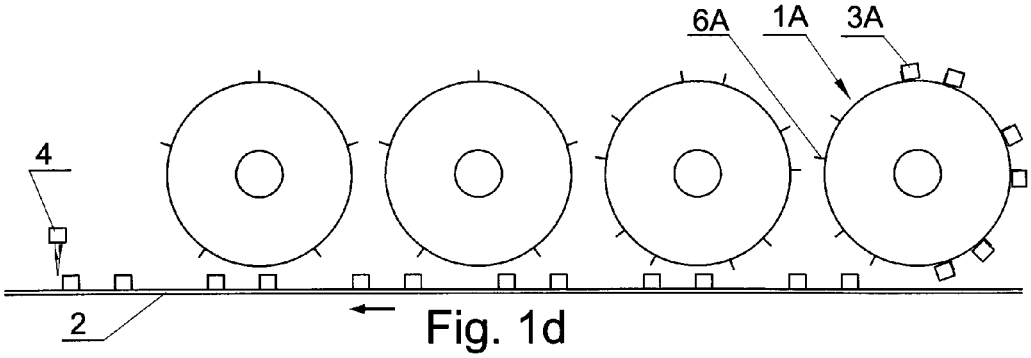
Figure 1E:
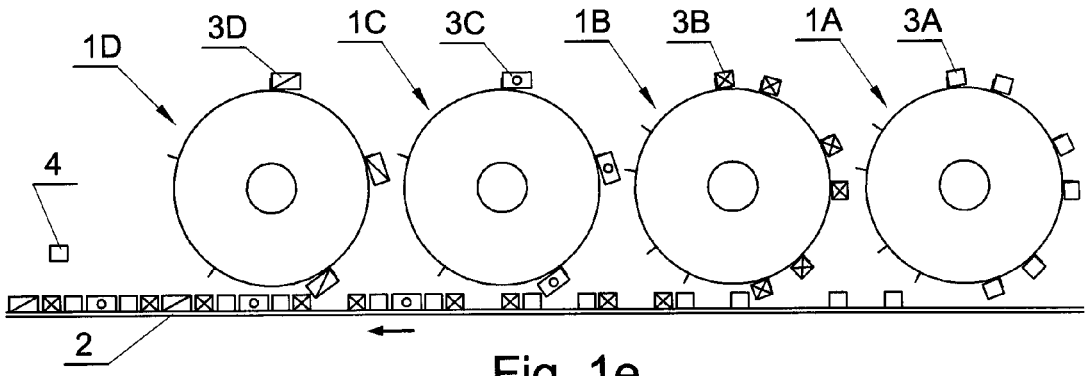
Figure 2A:
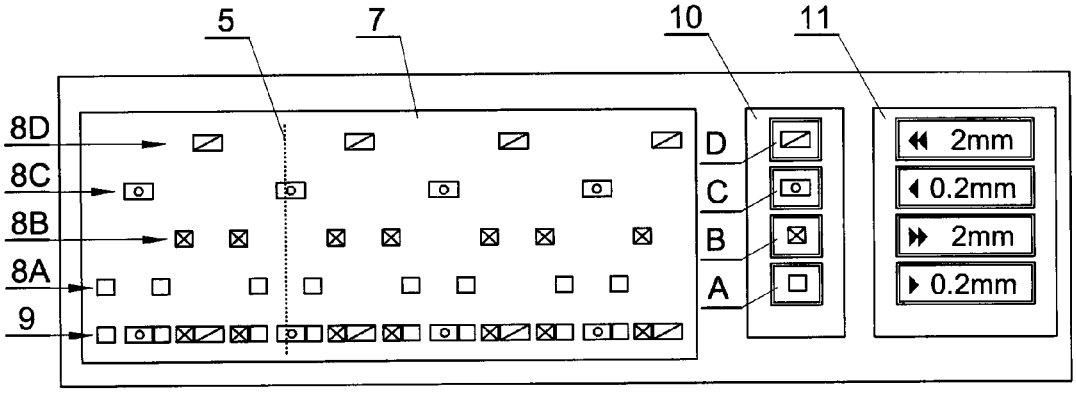
Figure 2B:
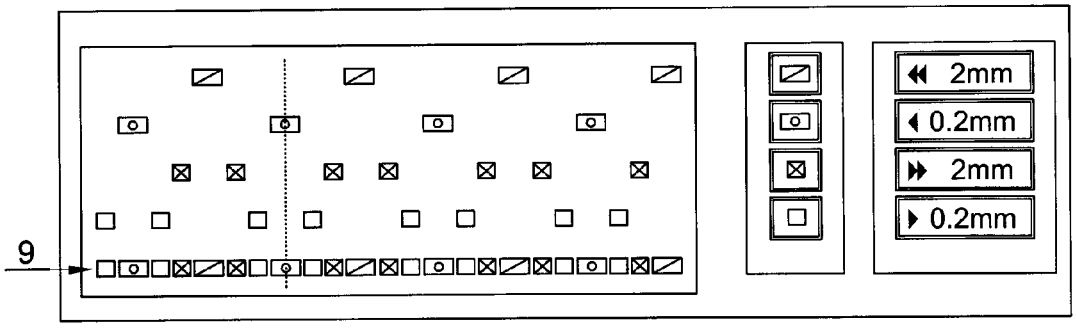
Figure 3A:
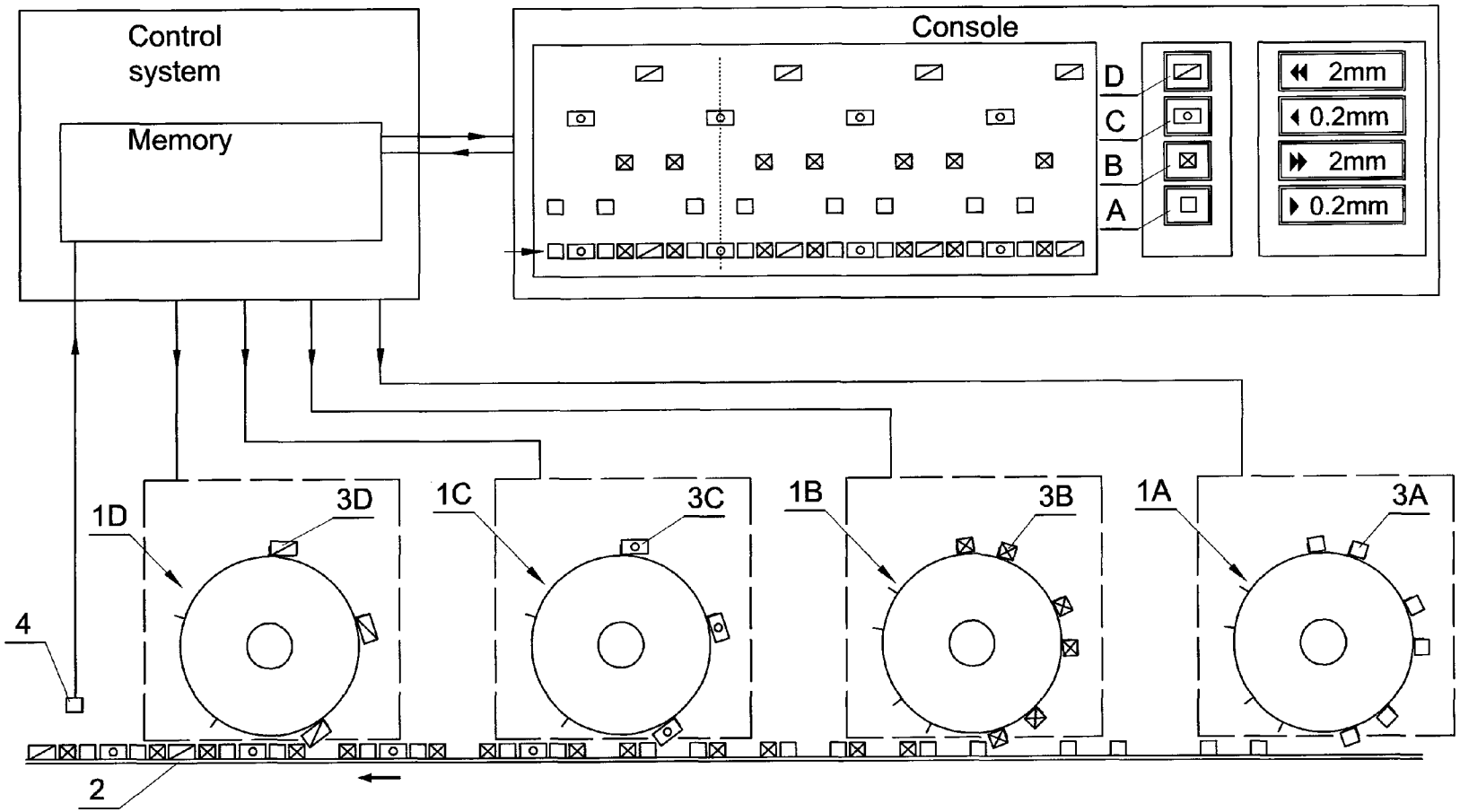
Figure 3B:
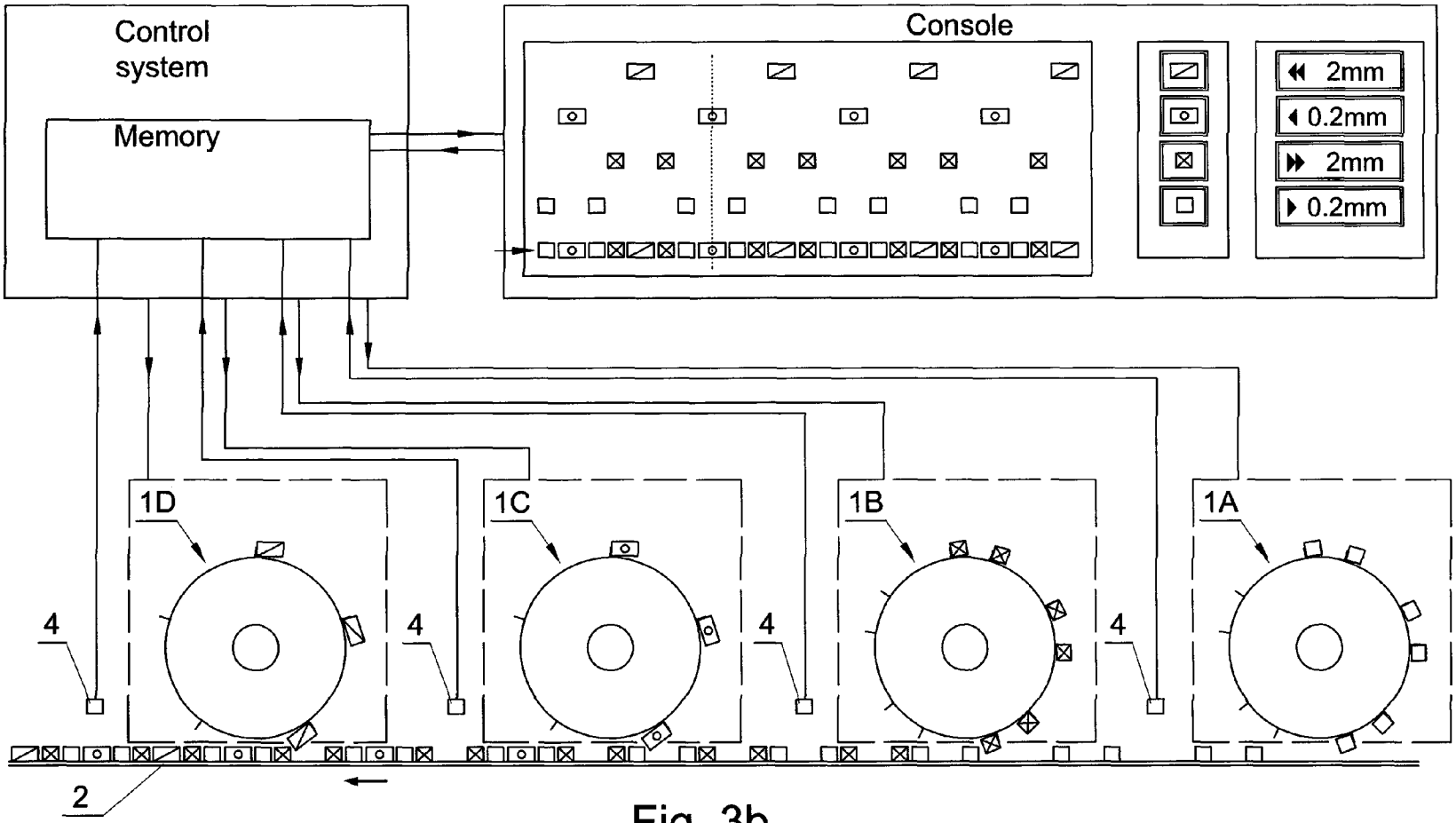
Figure 4A:
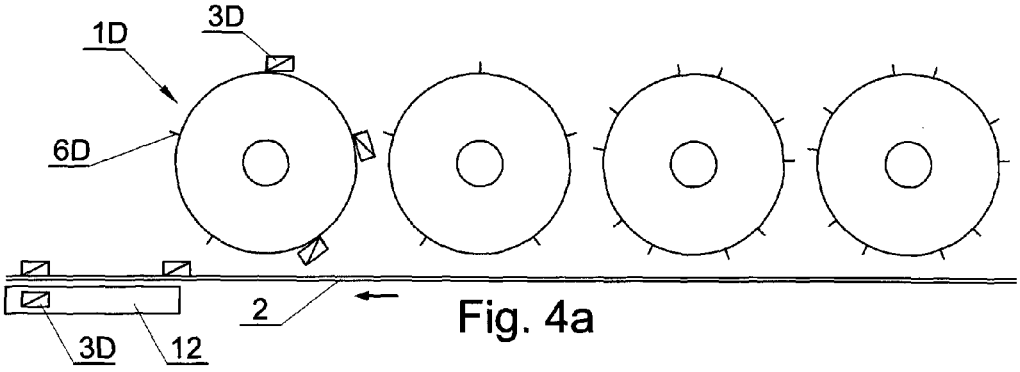
Figure 4B:
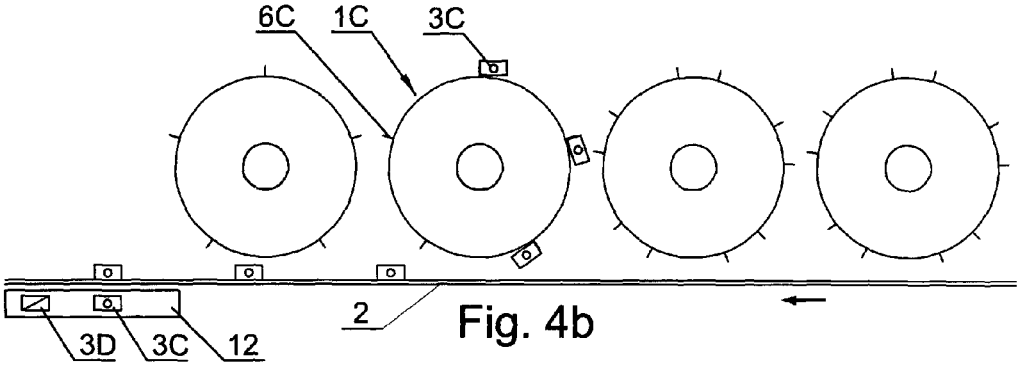
Figure 4C:
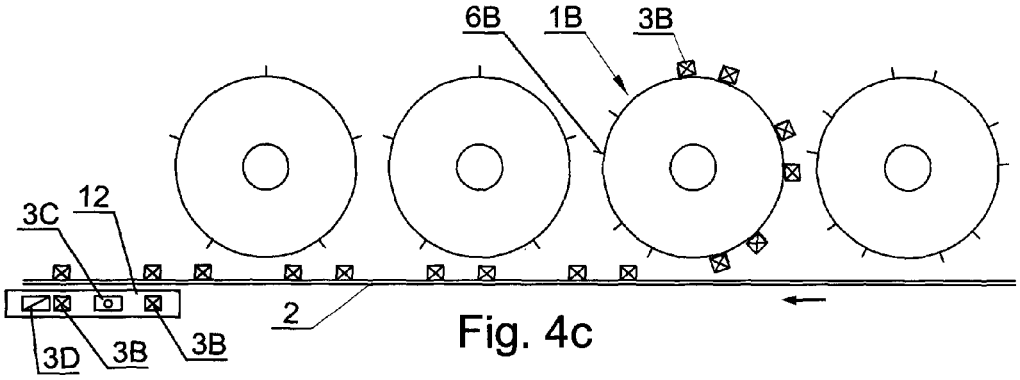
Figure 4D:
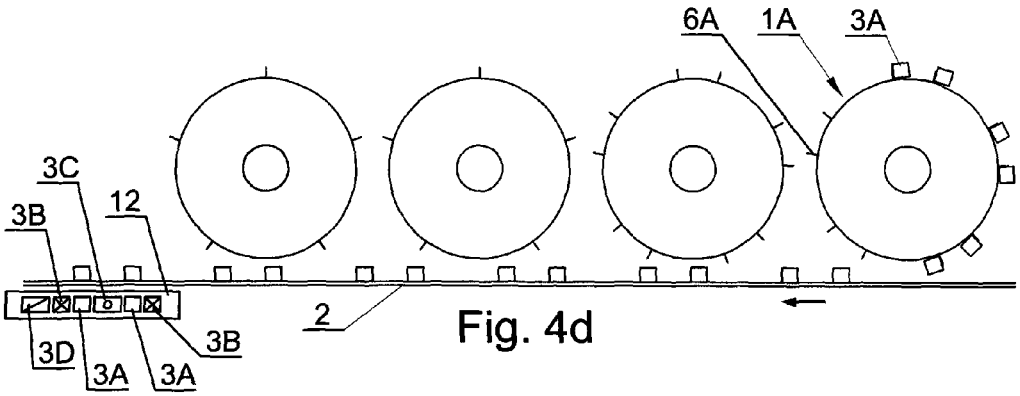
Figure 5A:
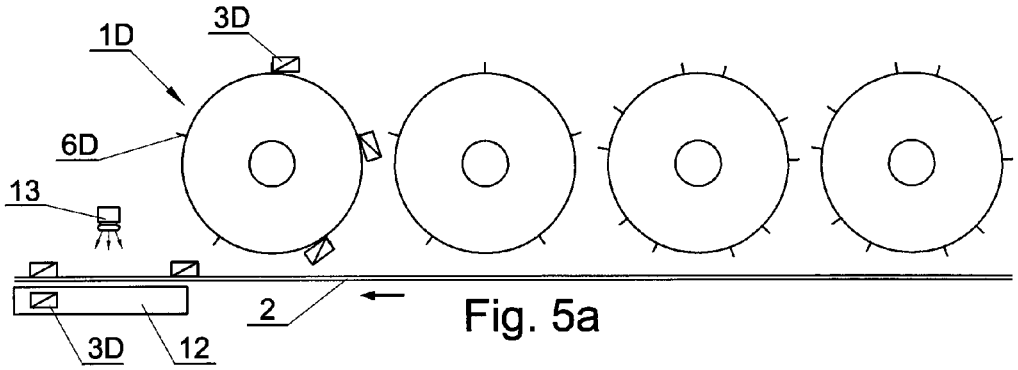
Figure 5B:
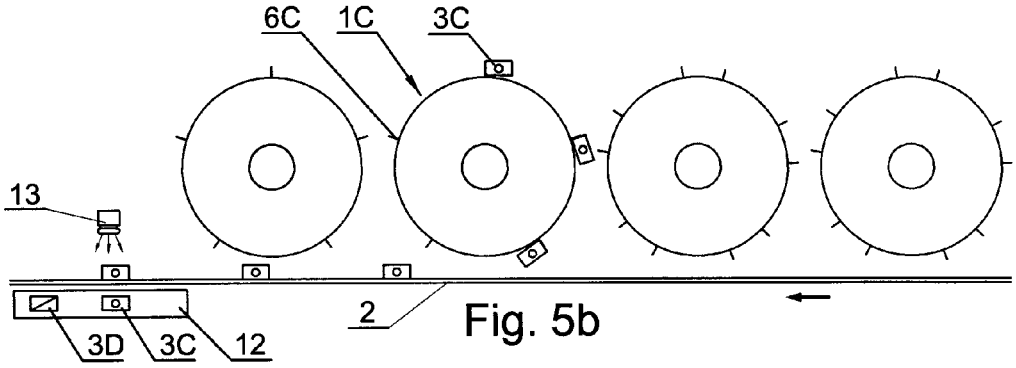
Figure 5C:
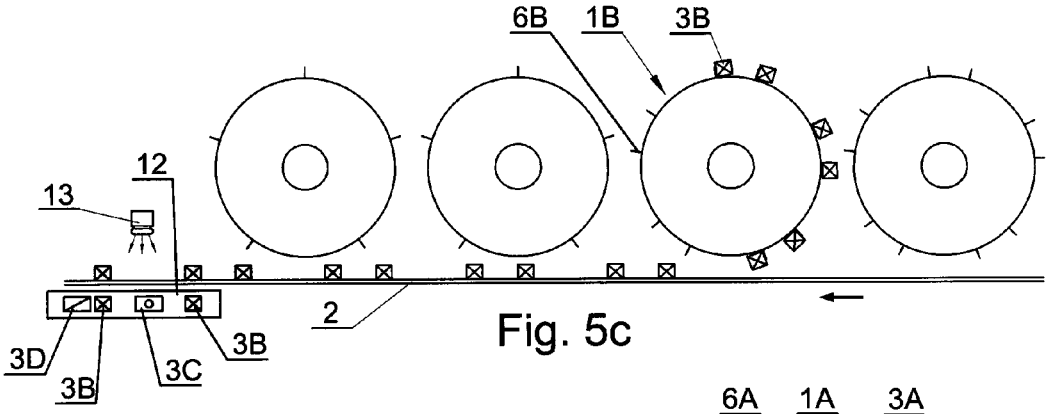
Figure 5D:
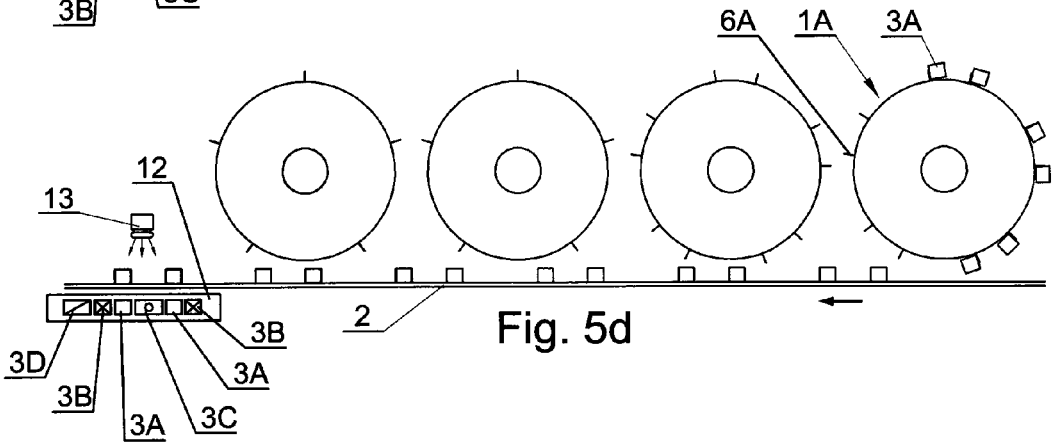
Figure 6A:
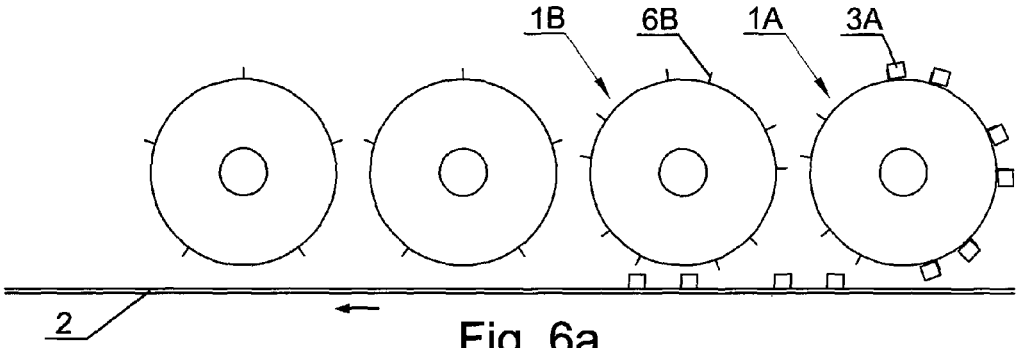
Figure 6B:
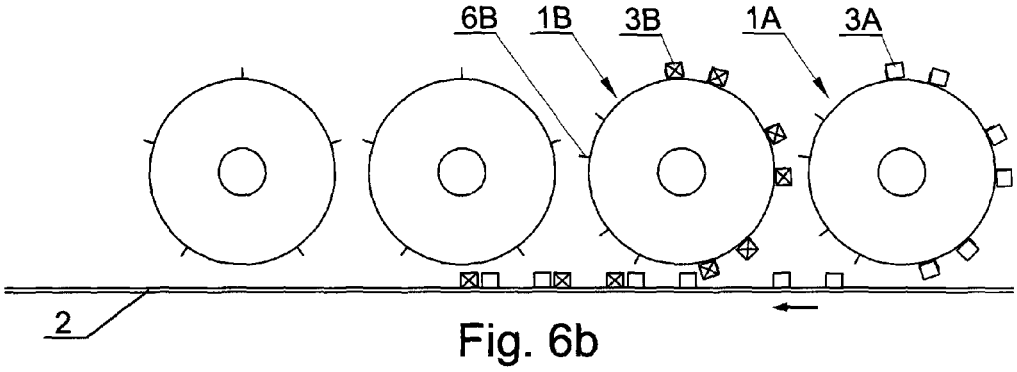
Figure 6C:
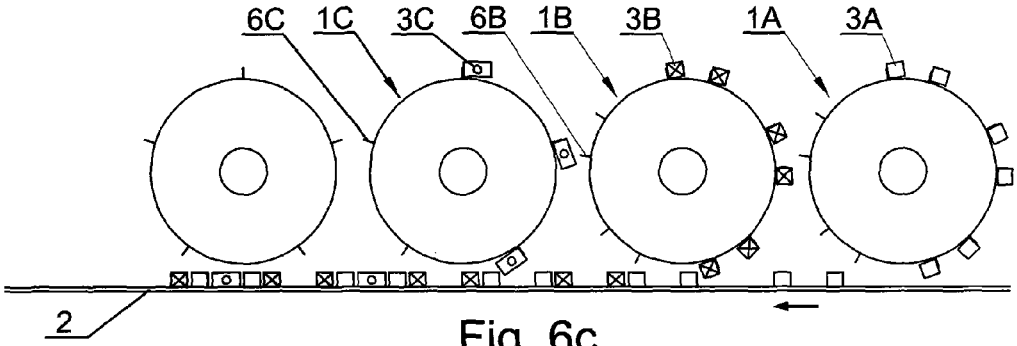
Figure 6D:
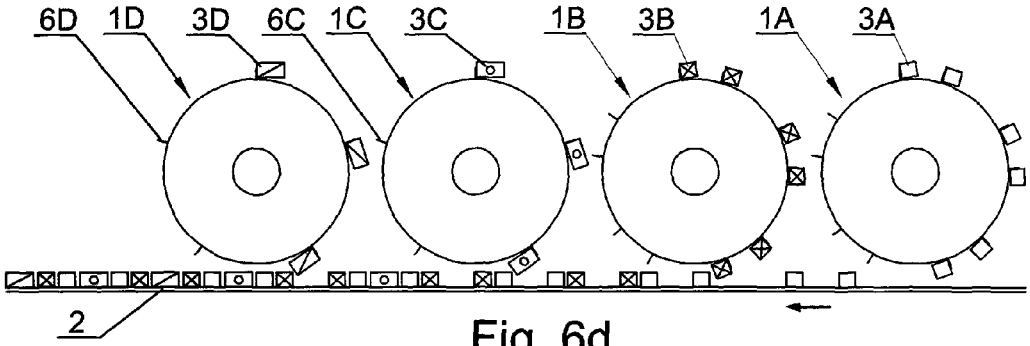

For the purpose of better understanding, the object of the invention was illustrated in embodiments in the figure in which FIG. 1 generally shows a fragment of the machine used in the tobacco industry for manufacturing multi-segment filters, provided with four modules, each of which feeds segments of appropriate type onto the carrier element of the grouping unit by means of the feeding device, and the position of the segments is registered by means of a common sensor situated behind the last module, which constitutes the embodiment I, wherein FIG. 1*a* illustrates setting of segments fed by the fourth, last module, FIG. 1*b*—setting of segments fed by the third, next to last module, FIG. 1*c*—setting of segments fed by the second module, FIG. 1*d*—setting of segments fed by the first module and FIG. 1*e*—a fragment of the machine during normal operation with the sensor switched off, FIG. 2 generally shows the interface console of the control system representing graphically the segments fed from four modules and their position on the carrier element as in embodiment I, wherein FIG. 2*a*—illustrates the state before the beginning of setting the position of the segments, whereas FIG. 2*b*—the state after setting the optimal position of the segments, FIG. 3*a*—the interrelation of the units of the machine with the control system when using one, common sensor, FIG. 3*b*—the interrelation of the units of the machine with the control system when using separate sensors for each module, which constitutes a modification of embodiment I, FIG. 4 generally shows a fragment of the machine as in FIG. 1 where the position of segments is registered by means of a registering element situated next to the carrier element behind the last module, which constitutes the embodiment II, wherein FIG. 4*a* illustrates setting of segments fed by the fourth, last module, FIG. 4*b*—setting of segments fed by the third, next to last module, FIG. 4*c*—setting of segments fed by the second module and FIG. 4*d*—setting of segments fed by the first module, FIG. 5 generally shows a fragment of the machine as in FIG. 4 where the position of the segments is registered by means of a registering element situated next to the carrier element behind the last module using the stroboscopic device, which constitutes the embodiment III, wherein FIG. 5*a* illustrates setting of the segments fed by the fourth, last module, FIG. 5*b*—setting of segments fed by the third, next to last module, FIG. 5*c*—setting of segments fed by the second module and FIG. 5*d*—setting of the segments fed by the first module, whereas FIG. 6 generally shows a fragment of the machine used in the tobacco industry for manufacturing multi-segment filters, provided with four modules, each of which feeds segments of the respective type onto the carrier element of the grouping unit by means of the feeding device, where the position of the segments is set by reciprocal adjustment of feeding devices of adjacent modules, which constitutes the embodiment IV, wherein FIG. 6*a* illustrates setting of segments fed from the first module, FIG. 6*b*—setting of segments fed from the second module, FIG. 6*c*—setting of segments fed from the third, next to last module and FIG. 6*d*—setting of segments fed from the fourth, last module.

Embodiment I. A machine for manufacturing multi-segment filters shown in a fragment in FIG. 1 consists of four similar modules 1, designated successively A, B, C, D, in the direction corresponding to the movement of a carrier element 2 of a grouping unit. Each of the modules 1 delivers, through a feeding device 6 onto the carrier element 2 respectively segments 3A, 3B, 3C, 3D which may differ in length and content. Behind the last module 1D, near the carrier element 2, is situated a sensor 4 registering the position and length of segments 3 on the carrier element 2 taking into consideration the reference point 5, which is the cutting line of a ready multi-segment rod, where the sensor 4 transmits the results of measurements to the control system of the machine. For the purpose of setting the reciprocal position of the segments 3 on the carrier element 2 at first the last module 1D is started which by means of the feeding device 6D conveys the segments 3D to the moving carrier element 2, where its length and position in relation to the reference point 5 is registered by the sensor 4, and the result of the measurement transmitted to the memory of the control system. Afterwards, the segments 3D are removed from the carrier element 2, whereas the feeding device 6D, not fed with segments 3D, remains switched on, which is necessary when setting the position of the next segment 3C (FIG. 1*a*). Then the next to last module 1C is started which by means of the feeding device 6C conveys the segments 3C onto the moving carrier element 2, and its length and position relative to the reference point 5, taking into consideration the distance from the segment 3D, is registered by the sensor 4, and the result of the measurement is transmitted to the memory of the control system (FIG. 1*b*). Similar activities are carried out in order to set the position of segments 3B (FIG. 1*c*) and segments 3A (FIG. 1*d*). A manual change of the reciprocal position of the segments 3 stored in the control system is carried out by means of the display field 7 of the control system interface (FIG. 2*a* and FIG. 3*a*) in which the segments 3D, 3C, 3B, 3A, fed respectively from the modules 1D, 1C, 1B, 1A, have been represented graphically in independent lines 8D, 8C, 8B, 8A where the registered arrangement of segments 3 on the carrier element 2 is presented in the display field 7 by means of the line 9. In the example shown, the distance between segments 3 requires regulation. After pressing one of the keys A, B, C, D in the panel 10, corresponding to the segments 3A, 3B, 3C, 3D, the position of the segment 3 in relation the reference point 5 and in relation to other segments 3 may be set manually by means of the control buttons 11, taking into consideration respective distances between the segments 3, which will be stored in the control system and represented graphically on the line 9. The sequence of segments 3 encoded in the control system will be mapped during normal operation of the machine, which is shown in FIG. 1*e*.

Alternatively, the method of setting the segments 3 may include the use of four sensors 4, respectively one situated behind each feeding device 6, which is shown in FIG. 3*b*.

Embodiment II. In FIG. 4, the machine as in embodiment I also in a fragment is shown, wherein the length and the position of segments 3 on the carrier element 2 is registered by means of the registering element 12 situated behind the last module 1A next to the carrier element 2. For the purpose of setting the reciprocal position of the segments 3 on the carrier element 2, at first the last module 1D is started which by means of the feeding device 6D conveys the segments 3D onto the carrier element 2 moving in slow motion, where the element 2 is stopped at the moment when the respective reference position is reached, and the position of the first segment 3D is marked on the registering element 12, after which the segments 3D are removed (FIG. 4*a*). Afterwards, similar activities are carried out for the segments 3C fed from the module 1C and the position and length of the segment 3C marked on the registering element 12 are compared with the previously marked position of the segment 3D and then, in case of improper arrangement of the segment 3C in relation to the segment 3D, the mechanisms of the module 1C are adjusted so as to obtain the expected position of the segment 3C in relation to the segment 3D by referring to the position of the segments 3D and 3C marked on the registering element 12. At the end, the module 1C is restarted in order to compare and control the position of fed segments 3C in the reference position of the carrier element 2 with previously registered position of the segment 3C on the registering element 12, and then the segments 3C are removed from the carrier element 2 (FIG. 4*b*). Similar activities are carried out for the purpose of setting the position of the segments 3B (FIG. 4*c*) and the segments 3A (FIG. 4*d*).

Embodiment III. In FIG. 5*a*, FIG. 5*b*, FIG. 5*c* and FIG. 5*d*, the machine as in embodiment II is shown, wherein the position of the segments 3 on the registering element 12 situated next to the carrier element 2 is marked by means of the stroboscopic device 13, which does not require stopping the carrier element 2 each time after the segment 3 being set has reached the reference position. All other operations in this embodiment are carried out in an identical way as in embodiment II.

Embodiment IV. In FIG. 6, the machine as in embodiments I, II and III is shown, but with a considerably simplified control system. For the purpose of setting the reciprocal position of the segments 3 on the carrier element 2, with the machine switched off, at first the module 1A is started which, by means of the feeding device 6A, conveys the segments 3A onto the carrier element 2 moving in slow motion, whereas the element 2 is stopped at the moment when the first segment 3A is placed in the feeding area of the segments 3B from the module 1B onto the carrier element 2 (FIG. 6*a*). Afterwards, the position of the feeding device 6B from the module 1B is set and stored taking into consideration the position of the segment 3A, and the control system adjusts the arrangement of the remaining mechanisms of the module 1B (FIG. 6*b*). In turn, the segments 3B and 3A set in a defined sequence on the carrier element 2 are moved so that the segment 3B is in the feeding area of the segments 3C from the module 1C and the position of the feeding device 6C from the module 1C is set and stored taking into consideration the position of the segments 3B and 3A, and the control system adjusts the arrangement of the remaining mechanisms of the module 1C (FIG. 6*c*). Similar operations are carried out for the segments 3D from the module 1D (FIG. 6*d*).

All procedures presented above refer to a situation when manufacturing of a new filter type is started or it was necessary to change the structure of the manufactured filter by changing the sequence of the segments 3 in the filter, changing one of the segments 3 to another or removing one of the segments 3. Setting of the segments 3 is carried out before the start or after interrupting the production of filters. After setting on the carrier element 2, during normal operation of the machine, the segments 3 are moved to further units in which they are pushed close to each other, wrapped in the cigarette paper, and then, by cutting the so formed continuous filter string, multi-segment filter rods are manufactured.

The invention claimed is:

1. A method of setting reciprocal positions of filter segments on a carrier element of a grouping unit in a process of manufacturing multi-segment filters used in the tobacco industry for cigarettes, comprising:

before starting or after stopping the process of manufacturing, delivering filter segments from multiple modules of a machine for manufacturing filters onto a carrier element of a grouping unit and arranging said segments in a sequence corresponding to the structure of a cigarette filter, wherein the sequence is in a direction corresponding to a direction of movement of the segments, before starting or after stopping the process of manufacturing, registering the position and length of a segment from each module on the carrier element of the grouping unit, and then setting the reciprocal position of the segments and the distance between the segments.

2. The method as in claim 1, further including:

feeding the segments from successive modules separately onto the carrier element of the grouping unit and conveying the segments to an area of operation of at least one sensor that registers the position and length of the segments, using the at least one sensor, registering the length of the fed segment and its position in relation to the carrier element of the grouping unit, storing the length and the position of the fed segment in a control system of the machine for manufacturing filters, after storing the registered information regarding the segments delivered from all modules, setting the required sequence of segments and the distance between the segments in the said control system, and using the control system, adjusting the position of mechanisms of individual modules is such as to obtain a set sequence of segments on the carrier element of the grouping unit.

3. The method as in claim 2, further including: having the length and position of the segments registered with one sensor, common for all modules, situated behind the last module.

4. The method as in claim 2, further including: having the length and position of the segments registered with a plurality of separate sensors, each of which is situated behind the respective module.

5. The method as in claim 3, further including: the sensor being an optical element operating in the range of visible radiation.

6. The method as in claim 3, further including: the sensor being an optical element operating in the range of invisible radiation.

7. The method as in claim 3, further including: the sensor being an ultrasonic element.

8. The method as in claim 1, further including:

a) feeding the segments from the last module onto the carrier element of the grouping unit, b) stopping the carrier element at a reference position at which the fed segments are placed behind the last module, marking the position of the segment on a registering element situated next to the carrier element, and then removing the segments from the carrier element, c) feeding the segments from the next to last module onto the carrier element of the grouping unit, d) stopping the carrier element at a reference position at which the fed segments are placed next to the said registering element and marking the position of the fed segment on that registering element, and then removing the segments from the carrier element, e) comparing the marked position of the segment fed from the next to last module with the previously marked position of the segment from the last module, f) adjusting the position of mechanisms from the next to last module such as to obtain the expected position of the segment from the next to last module in relation to the segment from the last module, g) restarting the next to last module such as to compare and control the position of the fed segments in the reference position of the carrier element with the position which was previously registered on the registering element, h) wherein the procedure as for the segments from the next to last module is carried out for segments from successive modules, up to the first module.

9. The method as in claim 1, further including:

a) feeding the segments from the last module onto the carrier element of the grouping unit, b) marking the position of the segment on a registering element situated next to the carrier element using a stroboscopic device, and then removing the segments from the carrier element, c) feeding the segments from the next to last module onto the carrier element of the grouping unit, d) marking the position of the fed segment on the registering element using a stroboscopic device, and then removing the segments from the carrier element, e) comparing the marked position of the segment fed from the next to last module with the previously marked position of the segment from the last module, f) adjusting the position of mechanisms of the next to last module such as to obtain the expected position of the segment from the next to last module in relation to the segment from the last module, g) restarting the next to last module such as to compare and control the position of the fed segments from the next to last module with the position of segments from the last module registered on the registering element, h) wherein the procedure as for the segments from the next to last module is carried out for the segments from successive modules, until the first module.

10. The method as in claim 1, further including:

a) feeding the segments from the first module onto the carrier element of the grouping unit and moving the segments so that the first fed segment is placed in the feeding area of the segments from the second module onto the carrier element, b) setting the position of the device feeding segments from the second module taking into consideration the position of the segment from the first module on the carrier element of the grouping unit, c) storing the set position of the feeding device of the second module, and the control system adjusting the arrangement of the remaining mechanisms of the module, d) moving the segments from the first and the second modules set in a defined sequence on the carrier element so that the said segments are placed in the feeding area of the segments from the third module, e) setting the position of the device feeding segments from the third module taking into consideration the position of segments from the second and first modules on the carrier element of the grouping unit, f) storing the set position of the feeding device of the third module, and the control system adjusting the arrangement of the remaining mechanisms of the module, g) wherein the procedure as for the segment from the third module is carried out for segments from successive modules, until the last module.

11. The method as in claim 4, further including: the sensor being an optical element operating in the range of visible radiation.

12. The method as in claim 4, further including: the sensor being an optical element operating in the range of invisible radiation.

13. The method as in claim 4, further including: the sensor being an ultrasonic element.

* * * * *